US006037090A

United States Patent [19]

Tanaka et al.

[11] Patent Number: 6,037,090

[45] Date of Patent: Mar. 14, 2000

[54] TONER FOR ELECTROPHOTOGRAPHY AND METHOD OF PREPARATION THEREOF

[75] Inventors: Hiroyuki Tanaka; Kazufumi Tomita; Hirotaka Matsuoka; Seiichi Takagi, all of Minami-Ashigara, Japan

[73] Assignee: Fuji Xerox Co., Ltd., Tokyo, Japan

[21] Appl. No.: 09/108,288

[22] Filed: Jul. 1, 1998

[30] Foreign Application Priority Data

Jul. 3, 1997 [JP] Japan ..... 9-178690

[51] Int. Cl.[7] ..... G03G 9/097

[52] U.S. Cl. ..... 430/106; 430/137

[58] Field of Search ..... 430/106, 109, 430/110, 137

[56] References Cited

U.S. PATENT DOCUMENTS

| | | | |
|---|---|---|---|
| 5,591,556 | 1/1997 | Shimomura et al. | 430/107 |
| 5,760,257 | 6/1998 | Tanaka et al. | 554/36 |
| 5,802,428 | 9/1998 | Ohno et al. | 430/110 |

FOREIGN PATENT DOCUMENTS

| | | |
|---|---|---|
| 36-10231 | 7/1961 | Japan . |
| 49-91231 | 8/1974 | Japan . |
| 56-40868 | 4/1981 | Japan . |
| 59-162562 | 9/1984 | Japan . |
| 60-222868 | 11/1985 | Japan . |
| 61-114247 | 5/1986 | Japan . |
| 5-119529 | 5/1993 | Japan . |
| 5-127422 | 5/1993 | Japan . |
| 7-152202 | 6/1995 | Japan . |
| 7-168395 | 7/1995 | Japan . |
| 7-271099 | 10/1995 | Japan . |
| 8-262796 | 10/1996 | Japan . |
| 9-12692 | 1/1997 | Japan . |

*Primary Examiner*—John Goodrow
*Attorney, Agent, or Firm*—Oliff & Berridge, PLC

[57] ABSTRACT

A colorant in a toner comprising a binder resin and a colorant is dispersed by a dispersant polymer having an acid value of from 1 mgKOH/g or more to 27 mgKOH/g or less and an amine value of from 1 or more to 100 or less. Thus, dispersibility of the colorant in the toner is improved, so as to obtain a negatively chargeable toner for electrophotography having excellent chargeability, storage ability, color developability, and light transmittance through OHP transparencies.

19 Claims, 1 Drawing Sheet

TONER FOR ELECTROPHOTOGRAPHY AND METHOD OF PREPARATION THEREOF

BACKGROUND OF THE INVENTION

1. Field of the Invention

The present invention relates to a toner for electrophotography, and a process for preparing the same.

2. Description of the Related Art

Conventionally, a kneading and pulverizing process has been known as a process for preparing a toner for electrophotography. Commonly, according to this process, components for the toner are kneaded and then pulverized to obtain the toner having a desired particle size. Presently, the toner prepared by this kneading and pulverizing process is widely used. However, as users are requiring higher performances, a superior toner has become necessary.

Presently, the performances sought greatly in regards to electrophotography are cleaner-less performance (which does not generate waste toner) which is closely linked with conservation of resources; and higher speeds, higher image quality and more compact structures of a device, which have been in greater demand with development of personal computers. Demand for these performances are especially intense in regards to color image-outputting devices, because of present circumstances that almost all computers display color images of excellent vividness.

However, the shape of the toner particles obtained by the kneading and pulverizing process is indefinite; therefore, there remains a problem that fluidity of the toner is low and an area of the toner particles contacting a surface of an electrostatic latent image support member is large, thereby decreasing transferability of images. Further, in the kneading and pulverizing process, colorants added to the toner appear on a surface of the obtained toner particles. Thus, an electric charge on the surface of the toner becomes non-uniform, resulting in a problem that a charge distribution of the toner is widened so that developability is lowered. At present, because of these problems, the kneading and pulverizing process cannot sufficiently satisfy the demand for the higher performances.

In order to satisfy the demand for the higher performances, various processes for preparing a toner have been proposed. For example, a toner having a capsule structure and processes for preparing this toner are proposed in Japanese Patent Application Laid-Open (JP-A) Nos. 60-222868, 61-114247, and 59-162562. According to these processes, the toner particles can be made spherical, so that it is possible to obtain the toner having excellent fluidity and transferability. Since colorants or the like do not appear on a surface of the toner particles, the obtained toner also has excellent uniformity in charging. However, the surface of the toner particles is completely covered with a hard shell, and consequently fixing property is low in a hot roll fusing method, which is the main trend at present, making it difficult to obtain a higher speeds and compact structures.

Japanese Patent Application Publication (JP-B) No. 36-10231 proposes a toner having a pseudo-capsule structure and a process for preparing the toner using a suspension polymerization method. In this suspension polymerization method, toner particles can be made spherical so as to obtain excellent fluidity and transferability. Colorants and the like are not liable to appear on a surface of the toner particles so that the obtained toner also has excellent uniformity in charging.

In many cases, however, raw materials used for a toner in the prior art cannot be used because resin is polymerized while the toner is prepared. Even in cases where it is possible to use conventional materials and carry out polymerization, particle size of the toner frequently cannot be controlled sufficiently because of influence of additives such as resin and colorants. Thus, this process has a problem that the raw materials cannot be freely selected. Particularly, there is a problem in that polyester resins, which exhibit excellent fixing property and color adaptability in the kneading and pulverizing process in the prior art, cannot be used in principle. Thus, the toner obtained by this process cannot sufficiently satisfy the demand for compact structures, higher speeds and colorization.

To overcome these problems, methods for preparing a toner by a dissolution suspension process are proposed in Japanese Patent Application Laid-Open (JP-A) Nos. 5-127422, 7-152202, 7-168395 and 7-271099. In the dissolution suspension process, an oil phase wherein toner components are dissolved or dispersed into an organic solvent is suspended in an aqueous phase to prepare toner particles. Since a polymerization process is not involved, a wide range of raw materials can be selected, and polyester resin and colorants can be used, thereby easily making the toner particles spherical and easily controlling particle size. For this reason, the toner having excellent fluidity and transferability can be obtained, and it is possible to realize a cleaner-less device. Since the toner obtained by this process has excellent fixing property and color adaptability and does not generate non-uniformity in charging caused by surfacing of a colorant, it is expected to be able to accommodate the demand for compact structures, higher speeds, and colorization.

However, even in the dissolution suspension process, wherein colorant components hardly appear on the surface of the toner particles, the colorant is liable to agglomerate so that it is difficult to add and disperse the colorant uniformly into the toner. Thus, variation is produced in the incorporation of the colorant among the toner particles, resulting in a problem of generating non-uniformity in charging, and of deteriorating stability in a case in which the toner is used for a long time. Furthermore, in a case of outputting color images, there occurs a problem in which a slight deterioration in developability and transferability impairs color balance and gradation. Further, the colorant in the toner is generally insoluble in the resin of the toner, and consequently transmissive light is irregularly reflected off interface between them, interfering with transmission of light through overhead projection(OHP) transparencies and the like. Thus, when the colorant is insufficiently dispersed, there occurs a problem of impairing the transmittance of light through the OHP transparencies.

Further, in a color image-outputting device in particular, it is common that in a fixing device an oil supplying device is unnecessary and that an oilless toner is used, wherein a releasing agent is added into the toner as a substitute for oil. However, the releasing agent cannot be made into particles as fine as a colorant, and uniform addition and dispersion of the releasing agent are difficult, so that there occurs a problem that chargeability, developability, storage ability and OHP transmittance are impaired when the releasing agent is poorly dispersed in the toner.

Using a flushing pigment as a method for dispersing the colorant is common in the kneading and pulverizing process. In the dissolution suspension process, however, even if the flushing pigment is used, a flushed resin is dissolved so that the flushing pigment cannot produce the aforementioned effect. Thus, dispersibility is not improved. In order to disperse the releasing agent, high shearing force can be easily applied in the kneading and pulverizing process. However, shearing force causing the releasing agent to be sufficiently dispersed cannot be applied in the dissolution suspension process.

Japanese Patent Application Laid-Open (JP-A) No. 5-119529 discloses that in an emulsion dispersing process, which is a process for preparing a toner which similarly involves use of a solvent, a graft resin is used as the binder resin to improve dispersibility of a colorant. To be certain, this process improves dispersibility of the colorant. However, since it is necessary to considerably increase a graft rate of the binder resin, a primary property of the binder resin is liable to deteriorate. This process causes, in particular, fixing property of a color toner and image quality thereof to deteriorate, and is not preferred.

As described above, a toner for electrophotography fully satisfying the demand for higher performances has not yet been obtained.

SUMMARY OF THE INVENTION

An object of the present invention is to provide a toner having offset resistance, chargeability, storage ability, color developability and OHP transmittance capable of meeting the demands for higher performance, by improving dispersibility of a colorant and a releasing agent in the toner to overcome problems in the prior art to a great extent.

The inventors of the present invention having earnestly investigated art in this field, found that addition of a dispersant polymer having a specified acid value and amine value improves dispersibility and dispersion stability of a colorant and thus were able to complete this invention.

Thus, the negatively chargeable toner for electrophotography according to the present invention comprises a binder resin and a colorant, the colorant being dispersed by a dispersant polymer having an acid value of from 1 mgKOH/g or more to 27 mgKOH/g or less and an amine value of from 1 or more to 100 or less.

It is preferred that the amount of the colorant added is from 1 part by weight or more to 50 parts by weight or less on the basis of 100 parts by weight of the binder resin, and that the amount of the dispersant polymer contained in the toner is from 0.1 by weight of the toner or more to 10% by weight of the toner or less. In a case wherein the dispersant polymer is a polycaprolactone derivative, it is preferred that the derivative is contained in the amount of from 1 part by weight or more to 50 parts by weight or less on the basis of 100 parts by weight of the colorant.

The dispersant polymer and the binder resin are preferably soluble in each other. More preferably the dispersant polymer is a polycaprolactone derivative. It is especially preferable that the derivative has a weight-average molecular weight of from 2000 or more to 10000 or less.

Further, it is preferred that the toner for electrophotography according to the present invention contains a releasing agent, that the amount of the releasing agent contained is from 1 part by weight or more to 50 parts by weight or less on the basis of 100 parts by weight of the toner for electrophotography, and that the melting point of the releasing agent is 120° C. or less. It is also preferred that the binder resin in the toner for electrophotography is a polyester resin.

It is especially preferred that a process for preparing toner for electrophotography according to the invention comprises the following steps: dissolving or dispersing into an organic solvent the binder resin and the colorant dispersed by the dispersant polymer having an acid value of from 1 mgKOH/g or more to 27 mgKOH/g or less and an amine value of from 1 or more to 100 or less, to prepare oil phase components, and dispersing the oil phase components into an aqueous solution, thereby forming particles. In short, it is preferred to prepare toner by using the dispersant polymer according to the present invention in a so-called dissolution suspension process.

The toner for electrophotography according to the present invention can be also prepared by a process comprising the following steps: dissolving of dispersing into a polymerizable monomer a colorant and a dispersant polymer having an acid value of from 1 mgKOH/g or more to 27 mgKOH/g or less and an amine value of from 1 or more to 100 or less, to prepare oil phase components, and dispersing the oil phase components into an aqueous solution to be polymerized, thereby forming particles. In short, the toner can also be prepared by using the dispersant polymer according to the present invention in a so-called suspension polymerization process.

In these processes, the oil phase components are preferably obtained by dissolving or dispersing into an organic solvent, together with the binder resin or the polymerizable monomer a colorant-dispersed solution wherein the colorant is beforehand dispersed into an organic solvent by the dispersant polymer. In a case of using the suspension polymerization process, it is preferred that the colorant is dispersed into the polymerizable monomer by the dispersant polymer to obtain the oil phase components.

It is preferred that the ratio of the colorant to the organic solvent in the colorant-dispersed solution is in the range from 5:95 to 50:50 and that the aqueous solution contains an inorganic dispersant and/or a dispersion stabilizer. In this case the inorganic dispersant content is from 0.1 parts by weight or more to 20 parts by weight or less on the basis of 100 parts by weight of a mother liquid.

The acid value and the amine value of the dispersant polymer used in the present invention kept within a specified range, thereby heightening affinity of the dispersant with the binder resin and the colorant, and successfully adjusting balance between their polar moieties and non-polar moieties. Thus, in a case in which the dispersant polymer used in the present invention is added into the toner, the dispersant would exhibit high dispersibility in regards to the colorant, the resin and the solvent, so as to improve dispersibility and dispersion stability of the colorant as well as fluidity of the toner while restraining influence on chargeability of the toner.

In other words, in the toner for electrophotography according to the present invention, due to the addition of the dispersant polymer into the colorant-dispersed solution, dispersibility of the colorant is improved. Further, color developability of the toner and light transmittance through OHP transparencies are improved, and efficiency in preparing the toner particles is heightened as well, since the colorant can be stably dispersed for a long time.

In particular, if the toner according to the present invention is prepared by using the dispersant polymer defined in the present invention in the so-called dissolution suspension process, fine particles of the colorant are uniformly dispersed in the toner particles and the amount of the colorant appearing on the surface of the toner particles is reduced, because of the difference in affinity between the colorant and the oil phase components, and between the colorant and the aqueous solution. Further, the resin and the colorant can be selected from a wider range of raw materials, and other additives such as wax can be added. The shape of the toner particles can be controlled and can be easily made spherical.

Therefore, the toner obtained by the present process has excellent chargeability, fluidity, stability and transferability. Namely, it is possible to form images having good image quality and light transmittance through the OHP transparencies by applying the toner according to the present invention to a developing agent for electrophotography.

Further, polycaprolactone type resins are biodegradable resins and consequently have advantages such as not causing environmental pollution.

DETAILED DESCRIPTION OF THE INVENTION

Figure 1:
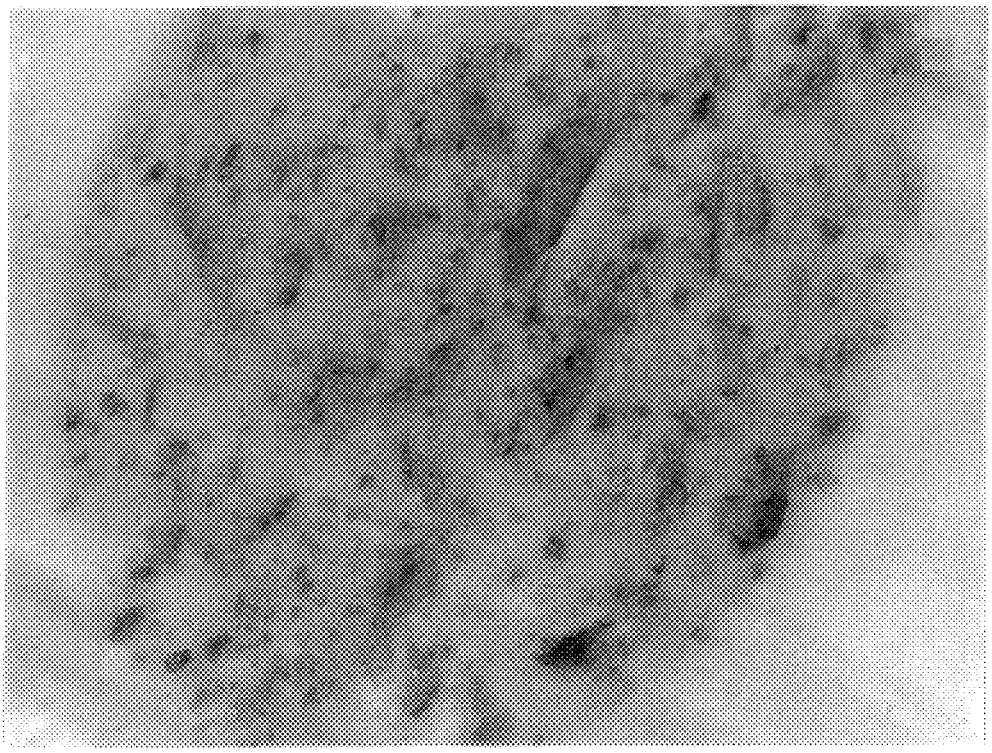
FIG. 1 is a photograph of a cross section of a toner in Example 1 under a transmission electron microscope.

The present invention will be described in detail below.

As a binder resin in the present invention, known resins used for fixing can be used.

Specific examples of the resin include polymers of acrylic ester such as methyl polyacrylate, ethyl polyacrylate, butyl polyacrylate, 2-ethylhexyl polyacrylate, lauryl polyacrylate; polymers of methacrylic ester such as methyl polymethacrylate, butyl polymethacrylate, hexyl polymethacrylate, 2-ethylhexyl polymethacrylate and lauryl polymethacrylate; copolymers of acrylic ester and methacrylic ester; copolymers of a styrene-based monomer and acrylic ester or methacrylic ester; ethylenical polymer or copolymers such as vinyl polyacetate, vinyl polypropiate, vinyl polybutylate, polyethylene and polypropylene; styrene-based copolymers such as styrene/butadiene copolymer, styrene/isoprene copolymer and styrene/maleic acid copolymer; polyesters obtained by condensation polymerization of an alcohol and a carboxylic acid; polyvinyl ether; polyvinyl ketone; polyester; polyamide; polyurethane; rubbers; epoxy resin; polyvinylbutyral; rosin; modified rosin; terpene resins; and phenol resins and the like. These resins may be used either singly or in combinations of two or more.

Among these, polyester, polystyrene, copolymers of a styrene-based monomer and an acrylic ester or methacrylic ester are preferred from the standpoint of color developability as a color toner and electrophotographic properties such as fixing strength and chargeability. Polyester is especially preferred from the standpoint of color developability.

Examples of an alcohol in a polyester obtained by condensation polymerization of an alcohol and a carboxylic acid include alcohols which are dihydric or greater such as ethylene glycol, diethylene glycol, triethylene glycol, polyethylene glycol, propylene glycol, butane diol, pentane diol, hexane diol, cyclohexanedimethanol, xylylene glycol, dipropylene glycol, polyprolylene glycol, bisphenol A, hydrogenated bisphenol A, bisphenol A ethyleneoxide, bisphenol A propyleneoxide, sorbitol, glycerin; and derivatives thereof. Examples of the carboxylic acid include dioic or more carboxylic acids such as maleic acid, fumaric acid, phthalic acid, isophthalic acid, terephthalic acid, succinic acid, adipic acid, trimellitic acid, pyromellitic acid, cyclopentanedioic acid, succinic anhydride, trimellitic anhydride, maleic anhydride and dodecenyl succinic anhydride; and derivatives and anhydrides thereof. The alcohols and the carboxylic acids may be used in combinations of two or more, respectively.

The weight-average molecular weight of the binder resin in the present invention is preferably in the range from 5000 to 10000. If the molecular weight is less than 5000, storage stability of the resin is liable to deteriorate. If the molecular weight is more than 10000, solubility of the resin into a solvent is liable to deteriorate. The glass transition point (Tg) thereof is preferably from 50 to 150° C. If the glass transition point (Tg) is less than 50° C., offsets of images are liable to be generated. If the glass transition point (Tg) is more than 150° C., fixing is liable to become insufficient.

The amount of the binder resin added in the present invention is usually from 50 parts by weight or more to 99 parts by weight or less on the basis of 100 parts by weight of the toner.

As colorants in the present invention, any known organic or inorganic pigment may be used. Specific examples of the colorants include: inorganic pigments such as Bengala, Prussian blue, titanium oxide and carbon black such as Furnace Black, Channel Black, Acetylene Black and Thermal Black; azo pigments such as Fast Yellow, Disazo Yellow, Pyrazolone Red, Chelate Red, Brilliant Carmine, Para Brown; phthalocyanine pigments such as copper phthalocyanine and metal-free phthalocyanine; and condensed polyring pigments such as Flavanthrone, Yellow, Dibromoanthrone Orange, Perylene Red, Quinacridone Red and Dioxazine Violet.

The amount of the colorant added is preferably from 1 part by weight or more to 50 parts by weight or less and more preferably from 2 parts by weight or more to 20 parts by weight or less on the basis of 100 parts by weight of the binder resin. If this amount is less than 1 part by weight, coloring ability is liable to deteriorate. If this amount is more than 50 parts by weight, fixing property and chargeability easily deteriorate.

In the present invention, the colorant is dispersed by a dispersant polymer having an acid value of from 1 mgKOH/g or more to 27 mgKOH/g or less, and an amine value of from 1 or more to 100 or less. A dispersant polymer, with an acid value of 20 mgKOH/g or less, and an amine value from 35 or more to 100 or less is more preferable.

If the acid value is more than 27 mgKOH/g, chargeability at high humidity deteriorates, and dispersibility of the colorant becomes insufficient. If the acid value is less than 1 mgKOH/g, affinity with the resin is lowered so that dispersibility of the pigment may become insufficient. If the amine value is less than 1 or more than 100, dispersibility of the pigment becomes insufficient.

The acid value can be measured by a method according to JIS (Japanese Industrial Standard) K 0070. Specifically, the dispersant polymer is dissolved in a 1 : 1 or 2: 1 mixed solution of diethyl ether with either 99.5% ethanol or isopropyl alcohol, and then phenolphthalein is added thereinto as an indicator. Titration is then carried out using a 0.1 mol/liter solution of potassium hydroxide in ethanol. The amount of the dispersant polymer, which is a sample, is 20 g, 10 g, 5 g, 2 g and 1 g in the case wherein the acid value is less than 5, not less than 5 and less than 15, not less than 15 and less than 30, not less than 30 and less than 100, and 100 or more, respectively. The acid value is calculated by using the value from the titration and the following equation:

$$\text{Acid value}=B\times F\times 5.611/S,$$

wherein B represents the amount (ml) of the 0.1 mol/liter solution of potassium hydroxide in ethanol which is required for the titration, F represents a factor of the 0.1 mol/liter solution of potassium hydroxide in ethanol, and S represents the weight (g) of a sample.

On the other hand, the amine value can be measured by a method according to JIS K 7237. Specifically, 8.5 ml of perchloric acid is added into a solution wherein 500 ml of acetic acid is beforehand mixed with 30 ml of acetic anhydride, and then mixed. Further, acetic acid is added into this mixture so that the total amount is 1000 ml. This mixture is permitted to stand a whole day and night to obtain a titrating solution. 100 ml of a solution of a mixture of 900 ml of o-nitrotoluene and 200 ml of acetic acid is added into a sample corresponding to 2–3 mmols of basic nitrogen, and then dissolved therein. Several drops of a 0.1 g/100 ml solution of Crystal Violet in acetic acid are then added into this mixture. Subsequently, titration is carried out by using the aforementioned perchloric acid until the blue color starts to turn greenish. The amine value is calculated by using the value from this titration and the following equation:

$$\text{Amine value}=56.11\times0.1\times(V_3-V_4)\times F/M_2,$$

wherein $V_3$ represents the amount (ml) of the 0.1 mol/liter perchloric acid solution which is required for the titration, $V_4$ represents the amount (ml) of the 0.1 mol/liter perchloric acid solution which is required for a blank test, F represents the factor of the 0.1 mol/liter perchloric acid solution, and $M_2$ represents the weight (g) of a sample.

The dispersant polymer and the binder resin preferably are highly soluble in each other from the standpoint of dispersibility of the pigment. As the dispersant polymer, polyester is preferable, particularly polycaprolactone derivatives such as polycaprolactone modified with diisocyanate or with a silane coupling agent having amino groups.

Specific examples of a dispersant polymer satisfying such requirements as stated above include "EFK47", "EFKA4009" and "EFKA4010" (modified polyurethane, ex EFKA CHEMICALS); "Ajispa PB711" and "Ajispa PN411" (ex Ajinomoto Co., Ltd.); "Disparlon DA-703-50", "Disparlon DA-705" and "Disparlon DA-725", which are polyesters; and "Disparlon DA-400N", which is a polyamide (ex Kusumoto Chemical Corp.).

It is preferred that the amount of the dispersant polymer contained in the toner is from 0.1% by weight of the toner or more to 10% by weight of the toner or less. If this amount is less than 0.1% by weight, dispersibility of the pigment becomes insufficient. If the amount is more than 10% by weight, chargeability at high humidity may deteriorate.

The weight-average molecular weight of the dispersant polymer is preferably 2000 or more, and more preferably 3000 or more, from the standpoint of pigment dispersibility. The weight-average molecular weight is the molecular weight of the main peak of the styrene-converted weight distribution in gel permeation chromatography.

In regards to polycaprolactone derivatives in particular, the weight-average molecular weight is preferably from about 500 to about 100000, and more preferably from 2000 to 100000. If the weight-average molecular weight is less than 500, polarization of the derivatives is raised so that colorant dispersibility is liable to deteriorate. If the weight-average molecular weight is more than 100000, affinity with solvents rises so that colorant dispersibility is liable to deteriorate.

The polycaprolactone derivative used in the present invention is a high polymer compound having $—(O(CH_2)_5CO)_n—$, $—(O(CH_2)_4CHCH_3CO)_n—$, $—(OCH_2CHCH_3(CH_2)_2CO)_n—$, or $—(O(CR_2)_5CO)_n—$, and may be obtained by ring-opening polymerization of ϵ-caprolactone. The derivatives include graft copolymers or block copolymers of ϵ-caprolactone and another monomer.

Examples of monomers which can be used above include: ϵ-caprolactam, ethylene, propylene, isoprene, butadiene, vinyl chloride, vinyl acetate, urethane, acrylic esters, methacrylic esters, styrene, acrylonitryl, vinylethyl ether, and derivatives thereof.

The amount of the polycaprolactone derivative added is preferably from 1 part by weight or more to 50 parts by weight or less and more preferably from 5 parts by weight or more to 30 parts by weight or less on the basis of 100 parts by weight of the colorant. If this amount is less than 1 part by weight, dispersibility of the derivative deteriorates. If this amount is more than 50 parts by weight, chargeability is liable to deteriorate.

These dispersant polymers may be used alone or in combination with other dispersants. Other dispersants that can be used include a polyester type dispersant; polymers of acrylic acid, methacrylic acid and/or its ester; and derivatives of the colorants.

In the present invention, a resin component is separated into the binder resin and the dispersant polymer, so that almost all of the dispersant polymer is absorbed on pigment particles, and an amount of the dispersant polymer (which has an amine value which easily causes positively charging) on the surface of the toner particles decreases. Thus, negative chargeability of the negatively chargeable toner is not obstructed.

Common organic solvents may be used as the solvent in a colorant-dispersed solution in the present invention. Examples thereof include: hydrocarbons such as toluene, xylene and hexane; halogenated hydrocarbons such as chloromethylene, chloroform and dichloroethane; alcohols such as methanol and ethanol; ethers such as tetrahydrofuran; esters such as methyl acetate, ethyl acetate and butyl acetate; and ketones such as acetone, methylethyl ketone and cyclohexanone, and the like. These may be used either singly or in combinations of two or more.

It is preferred that the ratio of the colorant to the organic solvent in the colorant-dispersed solution is in the range from 5:95 to 50:50. If the ratio of the added colorant is less than the above, the amount of the colorant-dispersed solution necessary in preparing the toner becomes greater, and efficiency in preparing the toner is liable to deteriorate. If the ratio of the added colorant is more than the above, dispersibility of the pigment is liable to become insufficient.

The colorant may be used in a colorant-dispersed solution obtained by dispersing only the colorant beforehand into the organic solvent. Alternately, the colorant may be dispersed directly into the organic solvent, together with the binder resin. Even in a case in which the colorant is dispersed beforehand, a small amount of the binder resin may be added to the colorant-dispersed solution to adjust viscosity in order to apply appropriate shearing force to the colorant-dispersed solution when the colorant is dispersed.

Dispersion of the colorant can be accomplished by mixing the colorant with the dispersant polymer in the solvent and then dispersing the mixture by using a common dispersing machine, for example, a media dispersing machine such as a ball mill, a sand mill, an attriter, and a coball mills; a roll mill such as a three-roll mill; a cavitation mill such as a Nanomaizer; a colloid mill; and an ultrasonic homogenizer.

The particle size of the colorant in the solution wherein the colorant is dispersed is desirably 1 μm or less. If the particle size is more than 1 μm, the particle size of the colorant when the toner is prepared becomes large so that image quality will be liable to deteriorate. In particular, light transmittance through OHP transparencies is liable to deteriorate. The particle size of the colorant can be obtained with a laser diffraction/scattering particle size distribution measuring machine "LA-700" (manufactured by Horiba Seisakusho Co., Ltd.).

In order to heighten the interaction between the colorant and the dispersant polymer and to stabilize dispersion of the colorant, it is preferred to add a colorant derivative having a strong affinity with the colorant into the colorant-dispersed solution or the like, or to conduct surface treatment of the colorant.

Specific examples of the colorant derivative include: dimethylaminoethylquinacridone; dihydroquinacridone; derivatives of anthraquinone carboxylic acid; derivatives of anthraquinone sulphonic acid; "Solsperse 5000", "Solsperse 12000" and "Solsperse 22000" (manufactured by Zeneca Co., Ltd.); and "EFKA-745" and "LP6750" (manufactured by EFKA Chemicals B.V.).

Examples of an agent for surface treating the colorant includes: natural rosin such as gum rosin, wood rosin and tall rosin; abietic acid or derivatives thereof such as abietic acid, levopimaric acid and dextropimaric acid; and metal salts thereof such as calcium, sodium, potassium and magnesium salts; rosin/maleic acid resin; and rosin/phenolic acid resin. An acid surface treating agent is especially preferred, to improve affinity with a pigment dispersant.

The added amount of the colorant derivative or the surface-treating agent of the colorant is preferably from 0.1 to 100% by weight of the colorant and more preferably from 0.1 to 10% by weight of the colorant.

In the present invention, a releasing agent may be added as another component in the preparation of toner particles, in order to gain releasing ability during fixing and enable use of a fixing roll with little or no oil. Even if the releasing agent is added in the preparation of the toner particles, there are no problems with dispersibility of the colorant in the present invention.

Examples of the releasing agent which can be used in the present invention include silicone oil and wax. Examples of the wax includes: a petroleum wax such as paraffin wax, paraffin oxide wax and mycrocrystalline wax; a mineral wax such as montan wax; an animal or plant wax such as carnauba wax; polyolefine wax; polyolefine oxide wax; a synthetic wax such as Fisher-Tropsch wax; and ester wax and ether wax and the like.

The melting point of the releasing agent is not limited to any specified range, but is preferably 150° C. or less from the standpoint of offset-resistance. The melting point is more preferably from 40 to 150° C., and most preferably from 50 to 120° C., from the standpoint of handling ease, ease of preparation and storage ability. However, releasing agents that are liquid at ordinary temperatures, that is, releasing agents whose melting points are less than 40° C., may be used as well.

It is desired that the releasing agent be beforehand dispersed more finely, that is, to an average size of 1 $\mu$m or less. When toner particles are prepared, fine particles of the releasing agent may be either added thereinto as they are or dispersed into a solvent. Examples of a wax-dispersing method for making the particle size of the wax fine include a method involving dissolving the wax into an organic solvent and then cooling it to disperse the wax finely, and a method involving vaporizing the wax in a gas phase to make the wax particles fine. As the organic solvent used in the former method, the same solvent(s) used in preparing toner particles may be used alone or in combination. However, the organic solvent used in the former method is not necessarily the same solvent(s) used in preparing toner particles. The amount of the solvent is desirably from 0.1 to 20 parts by weight on the basis of one part by weight of the wax. The wax can be melted by heating, pressing or the like. In the method of vaporizing the wax in the gas phase to make the wax particles fine, an inert gas such as helium, argon or nitrogen is used as the gas phase, and the wax is heated to a temperature from 100 to 400° C., and vaporized at a reduced pressure from 1.33 to 1333 Pa to deposit the vaporized fine particles of wax on a cooled substrate Then, the fine particles are obtained by scratching the fine particles off or dispersing the fine particles in a solvent. When preparing the toner particles, the wax fine particles may be either added as they are, or dispersed into a solvent. In the present method, fractions whose molecular weight distribution range is narrow can be separated by adjusting the temperature or the degree of reduced pressure.

The amount of the releasing agent to be added is preferably from 1 part by weight or more to 50 parts by weight or less on the basis of 100 parts by weight of the toner. If the amount of the releasing agent is less than 1 part by weight, releasing ability is liable to become insufficient. If the amount to be added is more than 50 parts by weight, the releasing agent easily appears on the surface of the toner, and chargeability and storage ability are liable to deteriorate.

As for other additives, fine particles of the following may be added, in order to improve fluidity: a metal oxide, such as silicon oxide, titanium oxide or aluminum oxide; a metal salt; ceramics; resin; and carbon black, or the like.

A process of adding the fine particles of the other additives may comprise: drying the toner, and then adhering the particles to a surface of the toner in a dry method by means of a mixer such as a V blender or a Henschel mixer; or dispersing the fine particles into an aqueous solvent such as water or water/alcohol, adding the dispersed solution into the toner which is in a slurry state, and drying the result, thereby adhering the external additive to the surface of the toner. It is also possible to spray the slurry onto a dry powder while carrying out drying.

The charging control agent which can be used in the present invention may be any one of those used in the prior art, but is preferably a compound selected from a group consisting of the following, which are used in toner powders in xerography: metal salts of benzoic acid, salicylic acid, alkylsalicylic acid and cathechol; metal-containing bisazo dyes; tetraphenylborate derivatives; tetraammonium salts; and alkylpyrydinium salts; a resin-type charging control agent having a polar group; and appropriate combinations thereof. The amount of the charging control agent added is desirably in the range from 0.1 to 10% by weight of solid components of the toner.

The organic solvent used in preparation of oil components in the present invention may be common organic solvents. This organic solvent is desirably the same as the dispersing solvent for the colorant but may be different from it. Examples of the organic solvent include: hydrocarbons such as toluene, xylene and hexane; halogenated hydrocarbons such as chloromethylene, chloroform and dichloroethane; alcohols such as methanol and ethanol; ethers such as tetrahydrofuran; esters such as methyl acetate, ethyl acetate and butyl acetate; and ketones such as acetone, methylethyl ketone and cyclohexanone and the like. These may be used either singly or in combinations of two or more.

From the standpoint of ease of controlling a shape of the toner particles, it is preferable to prepare the toner particles according to the present invention through a process involving suspending and dispersing, into an aqueous solution, oil phase components wherein at least the binder resin and the colorant-dispersed solution are dissolved or dispersed in the organic solvent for dissolving the binder resin. Then, the solvent is removed by heating and/or by reduced pressure, or a solvent having a small dissolving power is added to the toner particles to precipitate particles. Thus, toner particles can be obtained.

Examples of processes for preparing the toner according to the present invention also include: a process involving dissolving/dispersing heated and melted materials containing a binder resin and a colorant into the aqueous solution, and then cooling a resultant to form the toner particles, or a process of suspending/dispersing a liquid mixture containing at least a polymerizable monomer and a colorant-dispersed solution into the aqueous solution and then polymerizing the monomer.

Examples of the polymerizable monomer include: (meth) acrylic ester monomers such as methyl (meth)acrylate, ethyl (meth)acrylate, propyl (meth)acrylate, butyl (meth)acrylate, and isobutyl (meth)acrylate; vinyl ester monomers of carboxylic acid such as vinyl acetate; styrene-type monomers; and olefine type monomers.

For example, it is also possible to add other materials such as wax into the colorant-dispersed solution, or to add other materials, as they are or in a state in which they are dissolved or dispersed in an appropriate solvent, together with the colorant-dispersed solution or the like in the preparation of the particles.

The aqueous solution used in the present invention is mainly water, but may also be a mixture containing a water-soluble solvent. Examples of the water-soluble solvent include: alcohols such as methanol and ethanol; and acetone.

From the standpoint of particle size distribution of the toner, a dispersant is preferably added into the aqueous solution. The dispersants which can be used include: inorganic fine particles made of, for example, tricalcium phosphate, hydroxyapatite, calcium carbonate, titanium oxide, aluminum hydroxide, magnesium hydroxide, barium sulfate, and silica. The amount of the inorganic fine particles is preferably from 0.1 to 20 parts by weight on the basis of 100 parts by weight of a mother liquid. The average particle size of the inorganic fine particles is more preferably 1 $\mu$m or less. Here, the mother liquid is a liquid obtained after the oil phase components are dispersed into the aqueous solution.

Furthermore, it is preferred to add a water-soluble polymer, as a dispersion stabilizer, into the aqueous solution. Specific examples of the water-soluble polymer include: cellulose, hydroxypropylmethylcellulose, methylcellulose, carboxymethylcellulose, starch, polyvinylalcohol, polyacrylic acid; alkali metal salts thereof, such as sodium and potassium salts; and alkali earth metal salts; such as calcium and magnesium salts. These are formed into hydrophile colloid, so as to improve dispersion stability.

In a stirring process for preparing the particles, shearing force is preferably applied to a material. The following can be used to apply the shearing force: a homogenizer; stirring machines with a rotor and a stator, such as a colloid mill; stirring machines with an impeller, such as a dissolver; and an ultrasonic stirring machine, and the like.

For drying, the following are known: a ventilation drying machine, a spray drying machine, a rotary drying machine, an air flow drying machine, a fluid-layer drying machine, a heat-conducting drying machine, a freeze drying machine and the like. Any one thereof may be used.

In the toner according to the present invention, the whole or a part of a black colorant may be replaced with magnetic powder, so that a magnetic single component toner can be obtained. This toner can be used as a single component developer. The magnetic powder that can be used includes: magnetite, ferrite, or a simple substance such as cobalt, iron or nickel, and alloys thereof. A combination of the toner for electrophotography according to the present invention with a carrier may be used as a double component developer. In this case, it is preferable that the carrier has a resin coating layer.

The developer thus obtained can be used in a process for forming an image comprising steps of forming a latent image on an image support member, developing the latent image with a developing agent, and transferring a formed toner image onto a transferring member, specifically, in the step of developing a latent image with a developing agent. In short, the developing agent can be used in known image-forming machines such as copy machines, printers, facsimile machines and the like.

The aforementioned steps, per se, are conventional steps, and described in, Japanese Patent Application Laid-Open (JP-A) JP-A-Nos. 56-40868 and 49-91231, for example.

EXAMPLES

Example 1

Preparation of the Toners

The following were added into 75 parts by weight of ethyl acetate: 20 parts by weight of a colorant C. I. Pigment Blue B 15: 3, 4 parts by weight of a dispersant polymer, "Disparlon DA-725" (polyester amide amine salt, acid value: 20 mgKOH/g, amine value: 48, manufactured by Kusumoto Chemical Co., Ltd.), and 1 part by weight of a pigment derivative, "Solsperse 5000" (manufactured by Zeneca Co., Ltd.). Then the mixture was dissolved/dispersed by a sand mill to prepare a colorant-dispersed solution. Incidentally, the "Disparlon DA-725" was used after solvents therein were removed.

As a releasing agent, 30 parts by weight of paraffin wax (melting point: 89° C.) were used. This was heated and melted into 270 parts by weight of ethyl acetate and rapidly cooled to prepare a liquid containing finely dispersed wax.

As a binder resin, a polyester resin (Mw: 20000, Tg: 66° C., Tm: 106° C.) was used, obtained from bisphenol A propyleneoxide adduct, bisphenol A ethyleneoxide adduct, and a terephthalic acid derivative. 136 parts by weight of this binder resin and 34 parts by weight of the aforementioned colorant-dispersed solution were added into 56 parts by weight of ethyl acetate, and then the mixture was stirred. Subsequently, 75 parts by weight of the liquid containing finely dispersed wax were added into the mixture. The result was sufficiently stirred to become homogenous. This liquid comprised the oil phase components.

On the other hand, 40 parts by weight of calcium carbonate were added to 60 parts by weight of water, and dispersed by a ball mill for 10 hours. After that, 124 parts by weight of the calcium carbonate-dispersed solution, 99 parts by weight of a 2% aqueous solution of a sodium salt of carboxymethylcellulose, "Serogen BS-H" (manufactured by Daiichi Kogyo Seiyaku Co., Ltd.), and 157 parts by weight of water were stirred with a homogenizer "ULTRA-TURRAX" (manufactured by IKA Co., Ltd.) for 5 minutes to prepare an aqueous solution.

250 parts by weight of the aforementioned oil phase components were added into 345 parts by weight of the aqueous solution, and stirred with the homogenizer to obtain a mixture suspension liquid. This liquid was stirred with a stirrer having a propeller at room temperature and atmospheric pressure for 48 hours to remove the solvent. After adding, hydrochloric acid and removing the calcium carbonate, a resultant was washed with water, dried and classified to obtain a solid toner having an average particle size of 6.0 μm.

Example 2

A magenta toner was obtained in a same manner as in Example 1 except that the colorant, C. I. Pigment Blue B 15:3 in Example 1, was replaced with C. I. Pigment Red R 57:1, the dispersant polymer, "Disparlon DA-725" was replaced with "EFKA4010" (acid value: 25 mgKOH/g, amine value: 13, manufactured by EFKA Chemicals B.V.), and the pigment derivative "Solsperse 5000" was not added. "EFKA4010" was used after solvent therein was removed.

Example 3

A magenta toner was obtained in the same manner as in Example 1 except that the colorant, C. I. Pigment Blue B 15:3 in Example 1 was replaced with C. I. Pigment Red R 57:1, the dispersant polymer, "Disparlon DA-725" was replaced with "Ajispa PB711" (acid value: 2 mgKOH/g, amine value: 43, manufactured by Ajinomoto Co., Ltd.), and the pigment derivative "Solsperse 5000" was not added. "Ajispa PB711" was used after solvent therein was removed.

Comparative Example 1

A cyan toner was obtained in the same manner as in Example 1 except that neither the dispersant polymer, "Disparlon DA-725" nor the pigment derivative "Solsperse 5000" was added.

Comparative Example 2

A cyan toner was obtained in the same manner as in Example 1 except that the dispersant polymer, "Disparlon DA-725" was replaced with a different polymer-type dispersant, "Solsperse 2400SC" (acid value: 29 mgKOH/g, amine value: 39, manufactured by Zeneca Co., Ltd.).

Evaluation of the Toners

At a temperature of 28° C. and a humidity of 80%, 10 g of each of the obtained toners and 100 g of a ferrite carrier whose surface was coated with methyl polymethacrylate were mixed, and then charged quantities of each of the toners were measured by a blow-off method. At this time, charge distributions were sharp. Distributions in particle size of the toners were measured with a Coulter counter TA-II type (manufactured by Coulter Co., Ltd.). Surface shapes of the toner particles were observed under a scanning electron microscope.

Next, 1 part by weight of an external additive, "Silica R972" (manufactured by Nippon Aerosil Co., Ltd.) was added into 100 parts by weight of the toner and then mixed with a sample mill for 1 minute. This silica-containing toner was fixed, without use of a fixing fuser oil, in a modified machine of an electrophotographic, full-color copying machine "A-color 935" (manufactured by Fuji Xerox Co., Ltd.) to obtain an OHP fixed image.

Dispersibility of the colorant was estimated by observing cross sections of the toners under a transmission electron microscope. Specifically, toner samples were enveloped with epoxy resin and then cut. These cross sections were observed under a transmission electron microscope at an acceleration voltage of 100 kV.

Figure 2:
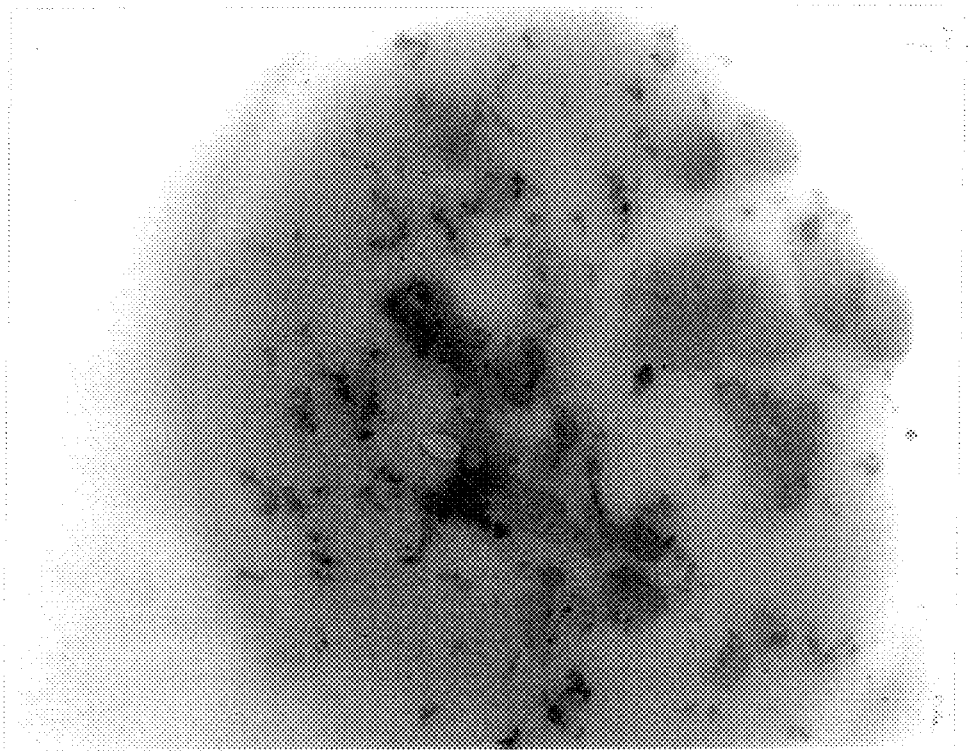
FIG. 2 is a photograph of a cross section of a toner in Comparative Example 1 under a transmission electron microscope.

FIG. 1 is a photograph of a section of the toner in Example 1 under the transmission electron microscope, and FIG. 2 is a photograph of a section of the toner in Comparative Example 1 under the transmission electron microscope. Photograph magnifications were 20000 and 15000 magnifications in FIG. 1 and FIG. 2, respectively.

In these photographs, small spots are colorants. Although the magnifications are somewhat different, when FIGS. 1 and 2 are compared, in the toner of Comparative Example 1 agglomerations of the colorant are present and areas wherein no colorant are present can be observed as well. On the other hand, in the toner of Example 1 the colorant is uniformly distributed in the toner and local agglomerations of the colorant are not observed. That is, it was confirmed that a dispersion state of the toner of Example 1 was good. The dispersion states of the other Examples and Comparative Examples were likewise confirmed.

Color developability on OHP transparencies was evaluated by fixing a solid color image onto a transparency for an overhead projection, projecting the image with the overhead projector, and then observing the vividness of the projected image with the naked eye.

Evaluation results are shown in Table 1.

TABLE 1

| | Average Toner particle size (μm) | Dispersant polymer | Amount of the added dispersant polymer per 100 parts by weight of the toner (parts by weight) | Acid value of the dispersant polymer | Amine value of the dispersant polymer | Pigment dispersion state | Toner Particle shape | Tribo value (μC/g) [28° C., 80%] | OHP color developability |
|---|---|---|---|---|---|---|---|---|---|
| Ex. 1 | 6 | Disparlon DA-725 | 0.9 | 20 | 48 | Good | spherical | −23 | Vivid blue |
| Ex. 2 | 6 | EFKA 4010 | 0.9 | 25 | 13 | Good | spherical | −20 | Vivid red |
| Ex. 3 | 6 | PB711 | 0.9 | 2 | 43 | Good | spherical | −17 | Vivid red |
| Comp. Ex. 1 | 6 | None | 0 | — | — | Agglomerations | spherical | −5 | Dark blue |
| Comp. Ex. | 6 | Solsperse 2400SC | 0.9 | 29 | 39 | Agglomerations | spherical | −3 | Dark blue |

(Ex. = Example, Comp. Ex. = Comparative Example)

As understood from results of the Examples and the Comparative Examples, the toner for electrophotography according to the present invention has good dispersibility of the colorant in the toner, excellent chargeability and uniform charge distribution. The color developability and light transmittance of the toner when fixed on OHP transparencies are also excellent. Furthermore, when the toner is prepared, agglomerations of the colorant are not generated. Thus, dispersion stability is good.

What is claimed is:

1. A negatively chargeable toner for electrophotography, comprising:

a binder resin, a dispersant polymer having an acid value of from 1 mgKOH/g to 27 mgKOH/g and an amine value of from 1 to 100, which dispersant polymer is a polymer other than the binder resin, and a colorant, said colorant being dispersed by the dispersant polymer undergoing sorption.

2. A negatively chargeable toner for electrophotography according to claim 1, wherein said dispersant polymer and said binder resin are soluble in each other.

3. A negatively chargeable toner for electrophotography according to claim 1, wherein said dispersant polymer is a polycaprolactone derivative.

4. A negatively chargeable toner for electrophotography according to claim 3, wherein the weight-average molecular weight of said polycaprolactone derivative is from 2000 or more to 10000 or less.

5. A negatively chargeable toner for electrophotography according to claim 3, wherein the amount of said polycaprolactone added is from 1 part by weight or more to 50 parts by weight or less on the basis of 100 parts by weight of the colorant.

6. A negatively chargeable toner for electrophotography according to claim 1, wherein the dispersant polymer is contained in the toner in an amount of 0.1% or more to 10% or less by weight of the toner.

7. A negatively chargeable toner for electrophotography according to claim 6, wherein said dispersant polymer is a polycaprolactone derivative.

8. A negatively chargeable toner for electrophotography according to claim 7, wherein the weight-average molecular weight of said polycaprolactone derivative is from 2000 or more to 10000 or less.

9. A negatively chargeable toner for electrophotography according to claim 1, wherein a releasing agent is also comprised.

10. A negatively chargeable toner for electrophotography according to claim 9, wherein the amount of the releasing agent contained is from 1 part by weight or more to 50 parts by weight or less on the basis of 100 parts by weight of the negatively chargeable toner.

11. A negatively chargeable toner for electrophotography according to claim 9, wherein the melting point of said releasing agent is 120° C. or less.

12. A negatively chargeable toner for electrophotography according to claim 1, wherein said binder resin is a polyester resin.

13. A method for preparing a negatively chargeable toner for electrophotography comprising the following steps:

dissolving or dispersing into an organic solvent a binder resin and a colorant dispersed by a dispersant polymer having an acid value of from 1 mgKOH/g or more to 27 mgKOH/g or less and an amine value of from 1 or more to 100 or less undergoing sorption which dispersant polymer is a polymer other than the binder resin, to prepare oil phase components, and dispersing said oil phase components into an aqueous solution, thereby forming particles.

14. A method for preparing a negatively chargeable toner for electrophotography according to claim 13, wherein the oil phase components are obtained by dissolving or dispersing into an organic solvent, together with the binder resin, a colorant-dispersed solution wherein the colorant is beforehand dispersed into an organic solvent by the dispersant polymer.

15. A method for preparing a negatively chargeable toner for electrophotography according to claim 14, wherein the ratio of said colorant to the organic solvent in the colorant-dispersed solution is in a range from 5:95 to 50:50.

16. A method for preparing a negatively chargeable toner for electrophotography according to claim 13, wherein said aqueous solution contains an inorganic dispersant.

17. A method for preparing a negatively chargeable toner for electrophotography according to claim 13, wherein said aqueous solution further contains a dispersion stabilizer.

18. A method for preparing a negatively chargeable toner for electrophotography according to claim 16, wherein the amount of said inorganic dispersant to be added is from 0.1 parts by weight or more to 20 parts by weight or less on the basis of 100 parts by weight of a mother liquid.

19. A method for preparing a negatively chargeable toner for electrophotography comprising the following steps:

dissolving or dispersing into a polymerizable monomer a colorant and a dispersant polymer having an acid value of from 1 mgKOH/g or more to 27 mgKOH/g or less and an amine value of from 1 or more to 100 or less undergoing sorption which dispersant polymer is a polymer other than the binder resin, to prepare oil phase components, and dispersing said oil phase components into an aqueous solution to be polymerized, thereby forming particles.

* * * * *